US009618254B2

(12) United States Patent
Jo et al.

(10) Patent No.: US 9,618,254 B2
(45) Date of Patent: Apr. 11, 2017

(54) REFRIGERATOR

(75) Inventors: Ilhyeon Jo, Seoul (KR); Seokjun Yun, Seoul (KR); Taehee Lee, Seoul (KR); Younghoon Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 566 days.

(21) Appl. No.: 13/548,141

(22) Filed: Jul. 12, 2012

(65) Prior Publication Data

US 2013/0019623 A1 Jan. 24, 2013

(30) Foreign Application Priority Data

Jul. 21, 2011 (KR) ..... 10-2011-0072310
Jul. 21, 2011 (KR) ..... 10-2011-0072311
Jul. 21, 2011 (KR) ..... 10-2011-0072312

(51) Int. Cl.
*F25D 11/02* (2006.01)

(52) U.S. Cl.
CPC ..... *F25D 11/025* (2013.01)

(58) Field of Classification Search
CPC ..... F25D 11/025; F25D 21/00; F25B 25/00; F25B 1/00; H01L 23/427; F28D 15/0266; F28D 15/02
USPC ..... 62/332, 190; 165/104.21, 104.22
See application file for complete search history.

(56) References Cited

U.S. PATENT DOCUMENTS 1,769,017 A * 7/1930 Davenport ..... F25B 9/006 62/83
1,957,313 A 5/1934 Bichowsky et al. ..... 62/95
2,669,853 A * 2/1954 Spiegelhalter ..... F25B 39/04 165/136
2,682,756 A * 7/1954 Clark et al. ..... 62/335
3,077,749 A * 2/1963 Jung et al. ..... 62/414
(Continued)

FOREIGN PATENT DOCUMENTS

CN 2143311 10/1993
CN 1187606 7/1998
(Continued)

OTHER PUBLICATIONS

European Search Report dated Apr. 9, 2014 issued in Application No. 12187590.0.
(Continued)

*Primary Examiner* — Allana Lewin Bidder
*Assistant Examiner* — Kun Kai Ma
(74) *Attorney, Agent, or Firm* — KED & Associates, LLP

(57) ABSTRACT

A refrigerator as disclosed herein may include a refrigerator body having a freezing compartment and a refrigeration compartment, a cooling circuit including a compressor, a condenser, and an evaporator to cool the freezing compartment and the refrigeration compartment using a first refrigerant, and a thermosyphon that includes a pipe for a second refrigerant to flow. The pipe may have a first section having a first prescribed shape for condensing refrigerant and a second section having a second prescribed shape for vaporizing refrigerant. A valve may be provided at the pipe to operate the thermosyphon. The cooling circuit and the thermosyphon may be operated independently. The thermosyphon may provide auxiliary cooling for the refrigeration chamber when the cooling circuit is not operational.

25 Claims, 17 Drawing Sheets

(56) References Cited

U.S. PATENT DOCUMENTS

| | | | | |
|---|---|---|---|---|
| 3,309,895 | A * | 3/1967 | Tamada | 62/475 |
| 4,459,826 | A | 7/1984 | Hirano et al. | 62/430 |
| 4,485,639 | A * | 12/1984 | Sakamoto | F25D 21/04 165/104.21 |
| 4,928,501 | A | 5/1990 | Negishi | 62/406 |
| 4,964,279 | A * | 10/1990 | Osborne | 62/59 |
| 5,527,105 | A * | 6/1996 | Riach, Jr. | 312/406 |
| 5,860,287 | A | 1/1999 | O'Neal | 62/201 |
| 6,397,618 | B1 | 6/2002 | Chu et al. | 62/259.2 |
| 6,789,392 | B1 * | 9/2004 | Miller et al. | 62/130 |
| 9,239,182 | B2 * | 1/2016 | Lee | F25D 11/02 |
| 2003/0010477 | A1 * | 1/2003 | Khrustalev | H05K 7/20681 165/104.33 |
| 2003/0177772 | A1 * | 9/2003 | Kwon | F25D 21/08 62/151 |
| 2003/0209025 | A1 * | 11/2003 | Lee | 62/272 |
| 2006/0185825 | A1 * | 8/2006 | Chen | F25B 25/005 165/104.21 |
| 2007/0028626 | A1 * | 2/2007 | Chen | F25B 25/00 62/6 |
| 2009/0194257 | A1 | 8/2009 | Niu et al. | 165/104.17 |
| 2009/0260371 | A1 * | 10/2009 | Kuehl et al. | 62/79 |
| 2010/0042476 | A1 * | 2/2010 | Gauri | 705/10 |
| 2010/0043455 | A1 * | 2/2010 | Kuehl | F25D 11/006 62/56 |
| 2010/0328882 | A1 * | 12/2010 | Campbell et al. | 361/689 |
| 2011/0011119 | A1 * | 1/2011 | Kuehl | F25D 16/00 62/434 |

FOREIGN PATENT DOCUMENTS

| | | | |
|---|---|---|---|
| CN | 1685183 | | 10/2005 |
| CN | 1880896 | | 12/2006 |
| DE | 10 2004 035 017 | A1 | 2/2006 |
| EP | 0 974 794 | A2 | 1/2000 |
| GB | 2 094 459 | A | 9/1982 |
| JP | 2-9779 | | 1/1990 |
| JP | 6-26748 | | 2/1994 |
| JP | 2003329317 | A * | 11/2003 |
| JP | 2006138605 | A * | 6/2006 |
| JP | 2007-192448 | | 8/2007 |
| WO | WO 2006008276 | A1 * | 1/2006 |
| WO | WO 2010/123405 | A1 | 10/2010 |

OTHER PUBLICATIONS

Chinese Office Action issued in related Application No. 201210408450.5 dated Aug. 26, 2014.

U.S. Notice of Allowance dated Dec. 19, 2014 issued in co-pending U.S. Appl. No. 13/611,779.

Chinese Office Action issued in related Application No. 201210252703.4 dated May 6, 2014.

* cited by examiner

REFRIGERATOR

CROSS-REFERENCE TO RELATED APPLICATION(S)

This application claims priority under 35 U.S.C. §119 to Korean Application No. 10-2011-0072310 filed in Korea on Jul. 21, 2011, 10-2011-0072311 filed in Korea on Jul. 21, 2011, and 10-2011-0072312 filed in Korea on Jul. 21, 2011, whose entire disclosure(s) is/are hereby incorporated by reference.

BACKGROUND

1. Field

The present disclosure relates to a refrigerator having a thermosyphon and more particularly, to a refrigerator in which a thermosyphon provides auxiliary cooling for the refrigeration chamber using the freezing chamber when the compressor is not operational.

2. Background

Refrigerators having a thermosyphon are known. However, they suffer from various disadvantages.

BRIEF DESCRIPTION OF THE DRAWINGS

The embodiments will be described in detail with reference to the following drawings in which like reference numerals refer to like elements wherein.

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
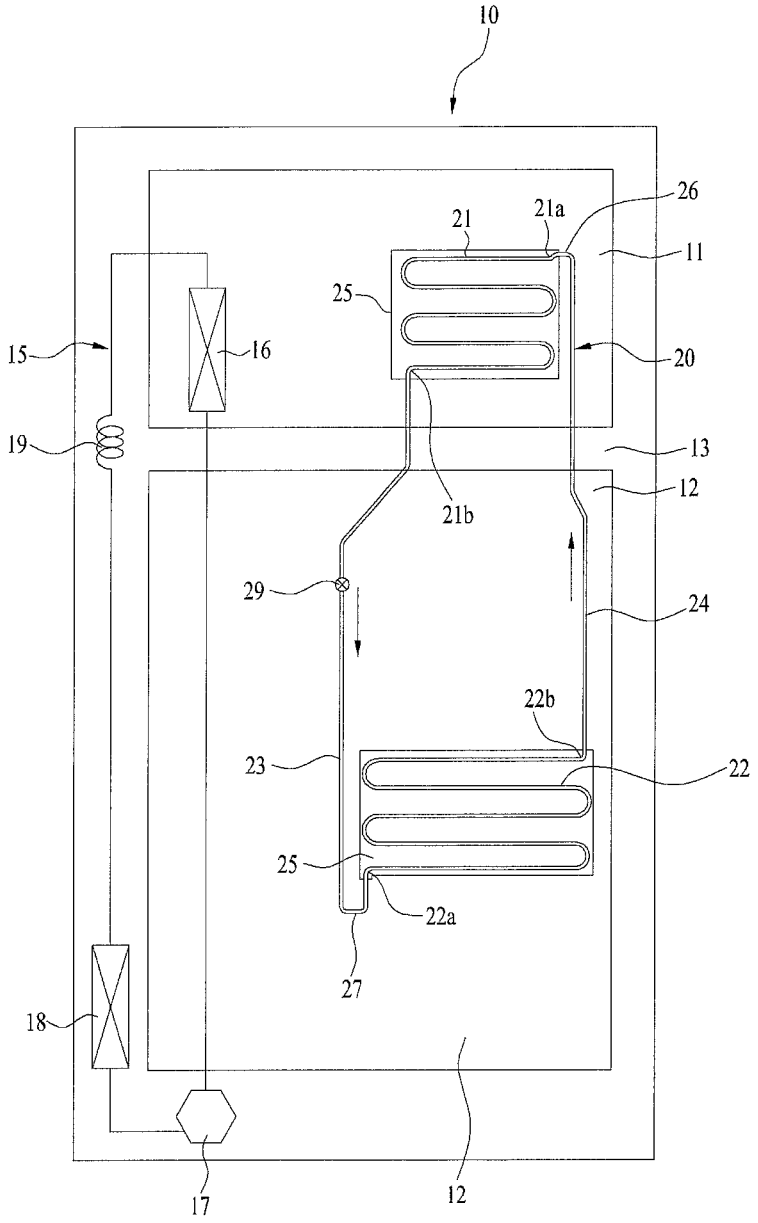
FIG. 1 is a conceptual view showing an embodiment of a thermosyphon according to the present disclosure.

The present disclosure relates to a refrigerator having a thermosyphon, and more particularly to a refrigerator in which a thermosyphon transmits cold air from a freezing compartment into a refrigeration compartment, in order to reduce a temperature increase within the refrigeration compartment while a compressor is not operated, such as, for example, in case of power outage.

In general, a refrigerator is an apparatus that keeps food, etc. at freezing or at a temperature slightly above freezing. To this end, the refrigerator contains hydraulic fluid that undergoes phase change at a specific temperature. As the hydraulic fluid is repeatedly vaporized and liquefied by absorbing heat within the refrigerator and emitting the absorbed heat to the outside, the interior of the refrigerator is cooled.

A refrigerator may be configured such that hydraulic fluid circulates through a cooling cycle (cooling circuit) that includes of a compressor, condenser, expander, and evaporator, that operates to cool the interior of the refrigerator. The compressor may be located in a rear lower region of a refrigerator body. Also, the evaporator, in which the hydraulic fluid undergoes heat exchange with interior air of a freezing compartment, may be attached to a rear wall of the freezing compartment.

The refrigerator has no problem in operation while power is normally supplied and the compressor is operated normally because the interior temperature of the refrigerator is constantly maintained owing to continuous supply of cold air. However, if cooling stops due to problems of the cooling cycle, such as a breakdown of the compressor or power outage, the interior temperature of the refrigerator may increase. In particular, food stored in the refrigeration compartment may be more sensitive to temperature increases and more susceptible to spoiling as temperatures rise above desired levels in the refrigeration compartment when the cooling circuit is not operating. Hence, there is a demand for techniques to prevent temperature increase in the refrigeration compartment in case of power outage.

Accordingly, the present disclosure is directed to a refrigerator that substantially obviates one or more problems due to limitations and disadvantages of the related art. An object of the present disclosure is to provide a device capable of preventing a temperature increase within a refrigeration compartment in the case in which a cooling cycle cannot be operated due to, e.g., power outage or breakdown, or under an environment in which power supply is restricted for energy conservation, etc.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

Hereinafter, a refrigerator having a thermosyphon according to the present disclosure will be described in detail with reference to the attached drawings. The same or similar elements are denoted by the same reference numerals, and a repeated description will be omitted.

FIG. 1 is a conceptual view showing an embodiment of a thermosyphon 20 according to the present disclosure. In FIG. 1, a refrigerator body 10, in which a cooling cycle 15 (cooling circuit) and thermosyphon 20 to cool the refrigerator are accommodated, is illustrated.

The present disclosure may be combined with smart grid technology. A smart grid is a power grid combined with Information Technology (IT), which allows bidirectional power information exchange between a power supplier and a consumer, thereby optimizing energy efficiency.

Meanwhile, in the present disclosure, power outage in which external power is not supplied to the refrigerator and a situation in which a power rate is high may be equally recognized. Thus, the refrigerator may perform a control operation to cut off external power in case of power outage and to prohibit use of external power for a time when a power rate is high. That is, in the above described two cases, a thermosyphon may be operated without using external power supplied. Of course, it may be possible to operate the cooling cycle instead of the thermosyphon for a time when a power rate is relatively low.

In the present disclosure, the thermosyphon may be separated from the cooling cycle included in the refrigerator such that different refrigerants individually circulate in the thermosyphon and the cooling cycle, thereby serving to cool a refrigeration compartment using cold air of a freezing compartment. In this case, since the thermosyphon functions as an auxiliary device of the cooling cycle, the cooling cycle may be not operated if the thermosyphon is operated. Similarly, the thermosyphon may be operated if the cooling cycle is not operated. Examples of the case in which the cooling cycle is not in operation may include power outage in which external electric power is not supplied, a breakdown of the cooling cycle, or the case in which an external electric power rate is high.

That the cooling cycle is not in operation may represent that the compressor, which is operated by externally supplied power, does not compress hydraulic fluid, and thus, circulation of the hydraulic fluid does not occur within the cooling cycle. Accordingly, the cooling cycle cannot function to supply cold air into the refrigerator.

Of course, even in the case in which external power is supplied, the compressor of the cooling cycle may be not operated, and thus, cold air may not be fed into the refrigeration compartment or the freezing compartment. In this case, the thermosyphon may be not operated. This is because the freezing compartment or the refrigeration compartment is sufficiently cooled, and thus, does not need additional circulation of cold air.

Moreover, it should be appreciated that as the cooling cycle and the thermosyphon are separate cooling circuits having separate refrigerants, they may be operated independently. For example, it should be appreciated that the cooling cycle may be turned on when the thermosyphon is turned off, the cooling cycle may be turned off when the thermosyphon is turned on, or both the cooling cycle and the thermosyphon may be turned on or off. In one embodiment, the operational states of the cooling cycle and the thermosyphon may be controlled based on prescribed energy modes, e.g., to conserve energy or to minimize costs, to maximize performance, or the like.

As described herein, the thermosyphon may provide auxiliary power when the cooling cycle is not operational. However, in certain cases, it may be desirable to continue operation of various components of the cooling cycle even during operation of the thermosyphon. For example, a fan included in the cooling cycle to circulate air in the storage chambers may be operated to enhance air circulation while the thermosyphon is operational. Accordingly, each component of the cooling cycle and the thermosyphon may be controlled individually based on the desired functions and availability.

The refrigerator body 10 may internally define a freezing compartment 11 and a refrigeration compartment 12 with a partition 13 interposed therebetween. The cooling cycle 15 may be accommodated in the refrigerator body 10 to cool the interior of the refrigerator body 10.

The cooling cycle 15 may be configured to artificially compress hydraulic fluid using a compressor 17 and to liquefy the compressed hydraulic fluid using a condenser 18. As the liquefied hydraulic fluid is changed into gas phase hydraulic fluid via expansion using an expander 19 and an evaporator 16, heat exchange occurs between the hydraulic fluid and surroundings, causing temperature drop in the surroundings.

The evaporator 16 of the cooling cycle 15 may be mounted in the freezing compartment 11 to cool the freezing compartment 11. Cold air of the freezing compartment 11 may be used to maintain the refrigeration compartment 12 at a desired temperature.

To ensure that the cooling cycle 15 continuously cools the interior of the refrigerator body 10, power must be applied to operate the compressor 17. Therefore, in case of power outage, operation of the compressor 17 stops, causing increases in temperature in the refrigerator body 10.

In the present disclosure, the thermosyphon 20 may be used to minimize or reduce increases in temperature in the refrigeration compartment 12 using cold air of the freezing compartment 11 in the case in which operation of the cooling cycle 15 is not possible or undesirable as described above.

The thermosyphon 20 is a device that performs movement of heat without requiring additional energy based on the principle that heat flows from hot to cold. If there is a temperature difference between one side and the other side, cold air or heat moves from one side to the other side.

The thermosyphon 20 may include a pipe formed to circulate refrigerant therein. The pipe may have several sections having prescribed shapes and may span from the freezing compartment 11 to the refrigeration compartment 12. For example, a portion of the thermosyphon 20 may be located in the refrigeration compartment 12 and the remaining portion may be located in the freezing compartment 11. The thermosyphon 20 may transfer heat using refrigerant circulating between the freezing compartment 11 and the refrigeration compartment 12.

The thermosyphon 20 may include a condensing portion 21 located in the freezing compartment 11, in which liquefaction of the refrigerant occurs, an evaporating portion 22 located in the refrigeration compartment 12, in which vaporization of the refrigerant occurs, a first connecting pipe 24 which connects an exit 22*b* of the evaporating portion 22 and an entrance 21*a* of the condensing portion 21 to each other and guides movement of the refrigerant from the evaporating portion 22 to the condensing portion 21, and a second connecting pipe 23 which connects an exit 21*b* of the condensing portion 21 and an entrance 22*a* of the evaporating portion 22 to each other and guides movement of the refrigerant from the condensing portion 21 to the evaporating portion 22.

While the refrigerant is configured to flow in the above described direction, one of ordinary skill in the art would appreciate that some amounts of refrigerant may flow in the opposite direction (e.g., backflow). Moreover, it should be appreciated that the thermosyphon 20 including the condensing portion 21 and the evaporating portion 22 may be provided at (e.g., in, on or near) the freezing compartment 11 and the refrigeration compartment 12, respectively, and is not limited to being positioned inside the respective compartments. For example, the pipe that forms the condensing portion 21 may be provided on an outer surface of the freezing chamber, an inner surface of the freezing chamber, or between the inner and outer surface of the freezing chamber, etc.

The refrigerant used in the thermosyphon 20 may have a vaporization temperature which may be equal to or less than the highest temperature of the refrigeration compartment 12 upon driving of the cooling cycle 15, e.g., during normal operation of the cooling cycle 15. The evaporating portion 22 of the thermosyphon 20 may be located in the refrigeration compartment 12, and serves to change liquid-phase refrigerant into gas-phase refrigerant by absorbing heat of the refrigeration compartment 12. Accordingly, if the vaporization temperature of the refrigerant is less than the highest temperature of the refrigeration compartment 12, the refrigerant may be vaporized by absorbing heat of the refrigeration compartment 12 so long as the cooling cycle is normally operated.

Meanwhile, the vaporization temperature of the refrigerant used in the thermosyphon 20 may be equal to or less than an average temperature of the refrigeration compartment 12 in a preset specific mode upon driving of the cooling cycle 15. In this case, the refrigerant present in the evaporating portion 22 may be vaporized at a lower temperature than the temperature of the refrigeration compartment 12 in a specific mode that is set by a user or is set automatically (for example, a low-temperature refrigeration mode and a high-temperature refrigeration mode). Accordingly, the vaporization temperature of the refrigerant used in the thermosyphon 20 may be within a limited variation range.

In particular, the vaporization temperature of the refrigerant used in the thermosyphon 20 may be equal to or less than the lowest temperature of the refrigeration compartment 12 that is realized upon driving of the cooling cycle 15. To ensure efficient operation of the thermosyphon 20, the refrigeration compartment 12, heat of which is observed by the evaporating portion 22, may be configured to have a higher temperature than the evaporating portion 22. That is, under the above described temperature condition, vaporization of the refrigerant may be configured to occur at a temperature that is equal to or less than the lowest temperature of the refrigeration compartment 12. This configuration may result in easier and more rapid vaporization of the refrigerant in the evaporating portion 22.

The condensing portion 21 may be located in the freezing compartment 11 and may serve to change gas-phase refrigerant into liquid-phase refrigerant. In the condensing portion 21, the refrigerant may emit heat into the freezing compartment 11 and store cold air of the freezing compartment 11. It should be appreciated that while the refrigerant is disclosed herein as changing state in the condensing portion 21, not all of the refrigerant may change state and a certain amount of refrigerant may not change state from a gaseous state to a liquid state in the condensing portion 21.

The condensing portion 21 may take the form of a serpentine pipe, which has an increased surface area to ensure efficient heat exchange. Also, to increase a heat exchange area, a heat transfer plate 25 may be attached to the condensing portion 21. The heat transfer plate 25 may be positioned between the condensing portion 21 and the freezing chamber 11. In particular, the heat transfer plate 25 may be formed of a highly thermally conductive material, such as a metal.

The condensing portion 21 may have a feature that, after the refrigerant has changed from a gas phase into a liquid phase, the refrigerant flows into the second connecting pipe 23 due to gravity. The entrance 21*a* (inlet) of the condensing portion 21 may be located higher than the exit 21*b* (outlet) of the condensing portion 21. For example, the condensing portion 21 may be inclined downward from an inlet to an outlet of the condensing portion 21 of the pipe.

Figure 2:
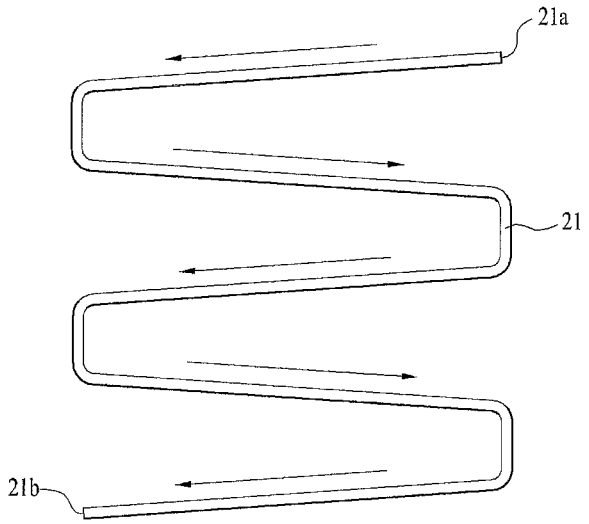
FIG. 2 is a view showing an embodiment of a condensing portion according to the present disclosure.
Figure 3:
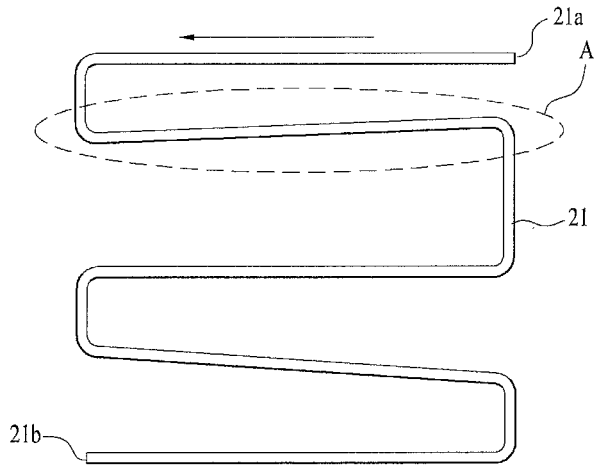
FIG. 3 is a view showing a comparative embodiment of the condensing portion shown in FIG. 2.

As shown by portion A of FIG. 3, if a pipe is inclined upward in a refrigerant flow direction, in other words, if downstream is located higher than upstream in the direction of gravity, the liquid-phase refrigerant has difficulty in moving to the second connecting pipe 23 due to gravity. To ensure a more smooth circulation of the refrigerant, as shown in FIG. 2, the entire condensing portion 21 may be gradually sloped downward in a refrigerant flow direction from the entrance 21*a* to the exit 21*b*.

In particular, in the present disclosure, backflow prevention members may be provided to prevent the refrigerant from moving backward, rather than circulating through the evaporating portion 22, first connecting pipe 24, condensing portion 21, and second connecting pipe 23. The backflow prevention members may include a first backflow prevention pipe 26 and a second backflow prevention pipe 27 that will be described hereinafter.

Generally, the thermosyphon 20 realizes circulation of heat or cold air as the refrigerant circulates in the sequence of the evaporating portion 22, the first connecting pipe 24, the condensing portion 21, and the second connecting pipe 23. If the refrigerant moves in a different direction from the above described direction, circulation efficiency may deteriorate. However, one of ordinary skill in the art would appreciate that certain amounts of refrigerant may move in a different direction from the above described direction. Accordingly, the present disclosure may employ the backflow prevention members to allow the refrigerant to circulate in a given direction.

The first backflow prevention pipe 26 may be provided at the entrance 21*a* of the condensing portion 21 to prevent the liquid-phase refrigerant from flowing backward from the entrance 21*a* of the condensing portion 21 to the first connecting pipe 24. The first backflow prevention pipe 26 may prevent backflow of the liquid-phase refrigerant generated in the condensing portion 21. The backflow prevention pipes may have prescribed shapes for preventing backflow of refrigerant in the gas or liquid state. As shown in FIG. 1, the first backflow prevention pipe 26 may be an inverted U-shaped bent pipe located at a position higher than the entrance 21*a* of the condensing portion 21. Alternatively, the first backflow preventing pipe 26 may have a Π-shape, Λ-shape bent form, or the like. The size, depth, angle, or shape of the backflow preventing portion 27 may be adjusted based on the desired amount of backflow prevention and the characteristics of the refrigerant.

In FIG. 1, the condensing portion 21 is arranged to define a vertical plane. This vertical arrangement of the condensing portion 21 is advantageous in terms of facilitating smooth flow of the refrigerant.

However, if a cooling aid or thermal storage device (30 in FIG. 8), such as a Phase Change Material (PCM), that will be described hereinafter is provided around the condensing portion 21, it may be desirable that the condensing portion 21 be arranged horizontally at the upper side of the freezing compartment 11 in consideration of the cooling effects of the freezing compartment 11 acquired by the cooling aid 30 (a more detailed description will hereinafter be given with reference to FIGS. 9 and 10).

Even when the condensing portion 21 is arranged horizontally, the first backflow prevention pipe 26 having a bent shape may be located near the entrance 21*a* of the condensing portion 21 at a position higher than the entrance 21*a*, so as to prevent backflow of the liquid-phase refrigerant.

Also, even in the case of the horizontally arranged condensing portion 21, the entrance 21*a* may be located higher than the exit 21*b* such that a slope is defined from the entrance 21*a* to the exit 21*b*, which assists movement of the liquefied refrigerant due to gravity.

Since the condensing portion 21 is pressurized as the gas-phase refrigerant, which has been vaporized in the evaporating portion 22, moves to the condensing portion 21 through the first connecting pipe 24, even if the entrance 21*a* of the condensing portion 21 is located lower than the exit 21*b* of the condensing portion 21, circulation of the refrigerant through the thermosyphon 20 may be accomplished so long as an angle between the entrance 21*a* and the exit 21*b* is within a predetermined angular range. Although the predetermined angular range may be changed based on the kind or amount of the refrigerant, for example, the liquid-phase refrigerant may exhibit normal circulation if the angle between the exit 21*b* and the entrance 21*a* of the condensing portion 21 is about −5 degrees.

The evaporating portion 22 may be located in the refrigeration compartment 12. The liquid-phase refrigerant liquefied in the condensing portion 21 moves to the evaporating portion 22 through the second connecting pipe 23, and then is changed into a gas phase refrigerant in the evaporating portion 22 by absorbing heat of the refrigeration compartment 12. It should be appreciated that while the refrigerant is disclosed herein as changing state in the evaporating portion 22, not all of the refrigerant may change state and a certain amount of refrigerant may not change state from a liquid state to a gaseous state in the evaporating portion 22.

The evaporating portion 22 may take the form of a serpentine pipe, which has an increased surface area to ensure efficient heat exchange. Also, to increase a heat exchange area, the heat transfer plate 25 may be attached to the evaporating portion 22. The heat transfer plate 25 may be positioned between the evaporating portion 22 and the refrigeration compartment 12. In particular, the heat transfer plate 25 may be formed of a highly thermally conductive material, such as a metal.

The gas-phase refrigerant has a low specific gravity and tends to ascend. Therefore, in consideration of the fact that the gas-phase refrigerant having passed through the evaporating portion 22 moves to the first connecting pipe 24, as shown in FIG. 1, the entrance 22*a* of the evaporating portion 22 may be located lower than the exit 22*b* of the evaporating portion 22.

Figure 4:
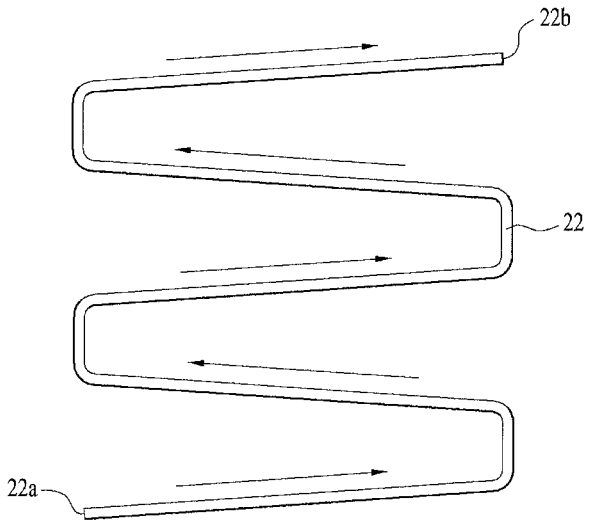
FIG. 4 is a view showing an embodiment of an evaporating portion according to the present disclosure.
Figure 5:
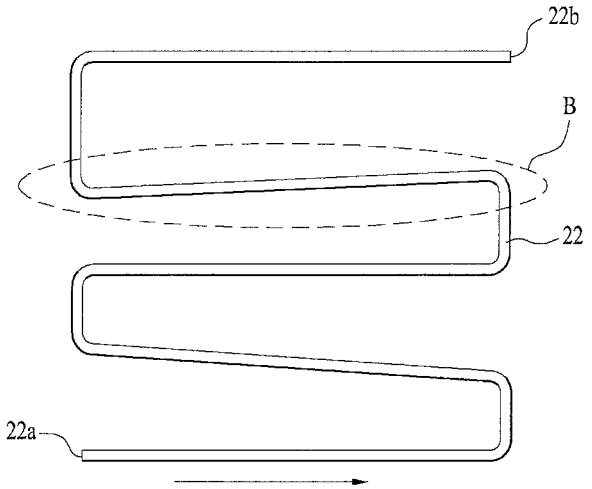
FIG. 5 is a view showing a comparative embodiment of the evaporating portion shown in FIG. 4.

Moreover, as shown in FIG. 4, the evaporating portion 22 may be gradually sloped upward in a flow direction of the gas-phase refrigerant. As shown by portion B of FIG. 5, if there is a zone that slopes downward in a gas flow direction, it may be an obstacle to flow of the gas-phase refrigerant in the thermosyphon 20 because gas tends to ascend.

To prevent the vaporized gas from moving to the second connecting pipe 23, the second backflow prevention pipe 27, which has a prescribed shape, may be provided at the entrance 22*a* of the evaporating portion 22 at a position lower than the entrance 22*a*. The second backflow preventing portion 27 may have a bent shape having a predetermined angle, for example, to have a U-shape, V-shape, a rectangular form, or the like. The size, depth, angle, or shape of the backflow preventing portion 27 may be adjusted based on the desired amount of backflow prevention and the characteristics of the refrigerant.

Since the second backflow prevention pipe 27 may be filled with the liquid-phase refrigerant, the second backflow prevention pipe 27 acts to prevent the refrigerant vaporized in the evaporating portion 22 from moving to the second connecting pipe 23 therethrough, thereby allowing the refrigerant to move to the first connecting pipe 24.

Figure 6:
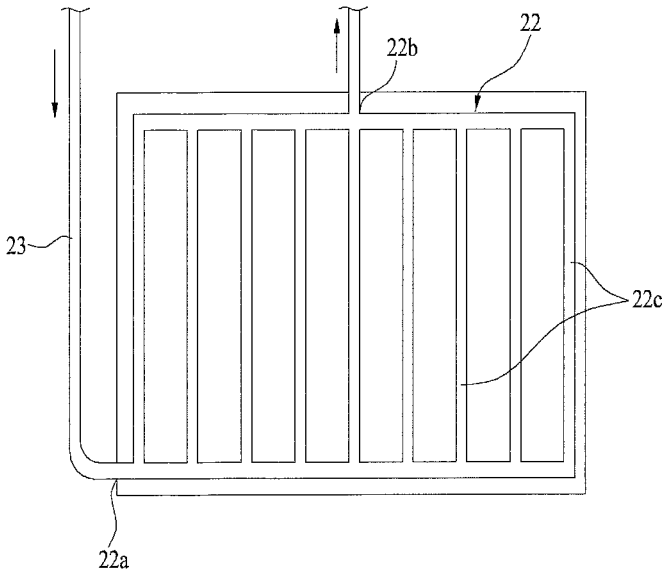
FIG. 6 is a front view showing another embodiment of an evaporating portion according to the present disclosure.

FIG. 6 is a front view showing another embodiment of the evaporating portion 22 according to the present disclosure. In the present embodiment, the evaporating portion 22 has a parallel structure to allow the vaporized refrigerant to easily move to the first connecting pipe 24. To realize this parallel structure, the evaporating portion 22 may include a plurality of channels 22*c* branched from the entrance 22*a* thereof, and the respective branched channels 22*c* may be converged into a single channel at the exit 22*b* of the evaporating portion 22 so as to be connected to the first connecting pipe 24. As shown in FIG. 6, the branched channels 22*c* may take the form of vertical linear pipes arranged in parallel to each other. When the branched channels 22*c* provide linear paths, more efficient flow of the gas-phase refrigerant may be accomplished. Moreover, the evaporating portion 22 may include a backflow preventing portion at the entrance 22*a* to prevent backflow of gaseous refrigerant in to the connecting pipe 23.

Figure 7:
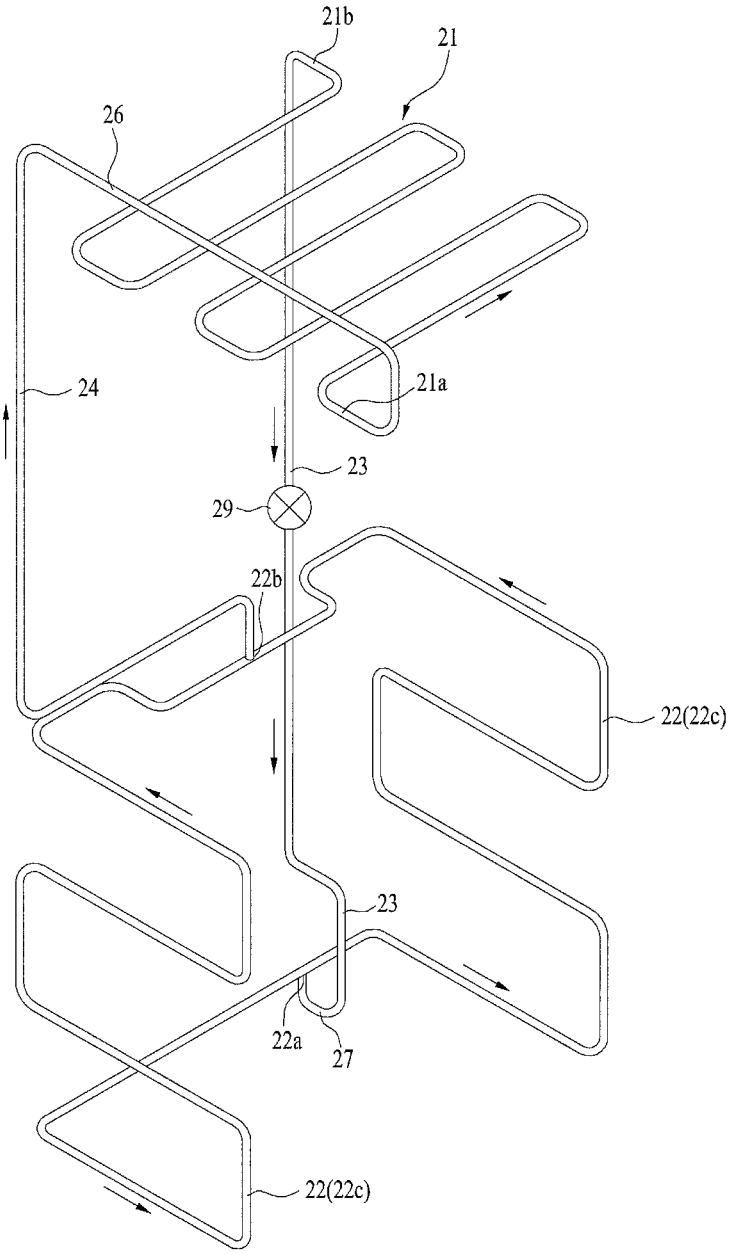
FIG. 7 is a perspective view showing still another embodiment of an evaporating portion according to the present disclosure.

FIG. 7 is a perspective view showing still another embodiment of the evaporating portion 22 according to the present disclosure. In the present embodiment, the evaporating portion 22 may have a combination of a parallel pipe structure and a serpentine pipe structure. The entrance 22*a* of the evaporating portion 22 may be branched into two channels 22*c*, and each branched channel 22*c* may have a serpentine shape and may extend along either sidewall surface of the refrigerator.

Arranging the two branched channels 22*c* respectively at both sidewall surfaces of the refrigerator enables heat exchange at both sides of the refrigeration compartment 12, which may allow a more uniform temperature to be maintained in the refrigeration compartment 12. Also, the parallel structure using the two branched channels 22*c* advantageously provides easier movement of the gas-phase refrigerant than a single channel.

Similarly, even in the case in which the evaporating portion 22 is branched into the plurality of branched channels 22*c*, as shown in FIG. 7, the first backflow prevention pipe 26 and the second backflow prevention pipe 27 may be provided to ensure that the refrigerant circulates in the desired direction.

The second connecting pipe 23 may connect the exit 21*b* of the condensing portion 21 and the entrance 22*a* of the evaporating portion 22 to each other, and the first connecting pipe 24 may connect the exit 22*b* of the evaporating portion and the entrance 21*a* of the condensing portion 21 to each other. The second connecting pipe 23 may provide for movement of the liquid-phase refrigerant that has been liquefied in the condensing portion 21, and the first connecting pipe 24 may provide for movement of the gas-phase refrigerant that has been vaporized in the evaporating portion 22.

If the liquid-phase refrigerant moves from the condensing portion 21 to the first connecting pipe 24, or the gas-phase refrigerant moves from the evaporating portion 22 to the second connecting pipe 23, this is counter to a circulation direction of the thermosyphon 20. To prevent this phenomenon, the first backflow prevention pipe 26 and the second backflow prevention pipe 27 may be provided.

The refrigerant may circulate in the sequence of the condensing portion 21, second connecting pipe 23, evaporating portion 22, and first connecting pipe 24 to thereby return to the condensing portion 21. This circulation may be initiated when operation of the cooling cycle 15 stops. Accordingly, the thermosyphon 20 may be provided with a valve 29 to block a circulation passage of the refrigerant while the cooling cycle 15 is normally operated. More specifically, when it is unnecessary to operate the thermosyphon 20, the valve 29 may close the second connecting pipe 23. The valve 29 may be provided at the first connecting pipe 23. The valve may also be provided at the second connecting pipe 24 or another appropriate position.

Moreover, in addition to the valve 29, a separate valve may be provided to close the first connecting pipe 24. That is, when the thermosyphon 20 is not in operation, it is possible to simultaneously close the first connecting pipe 24 and the second connecting pipe 23. For example, when both connecting pipes 23 and 24 are closed using the two valves, downward movement of the liquid-phase refrigerant through the second connecting pipe 23 may be limited, and simultaneously upward movement of the gas-phase refrigerant through the first connecting pipe 24 may be limited. Accordingly, providing the two valves may more rapidly and easily stop operation of the thermosyphon 20 than providing a single valve.

In the following description, it is assumed that the valve 29 is installed only at the second connecting pipe 23. While the valve 29 closes the second connecting pipe 23, the liquid-phase refrigerant is accumulated in an upper end of the second connecting pipe 23. Thereby, once the liquid-phase refrigerant of the thermosyphon 20 has been sufficiently accumulated in the second connecting pipe 23, circulation of the refrigerant stops, causing the thermosyphon 20 to be no longer operated.

That is, after a predetermined time has passed after closing a flow path of the second connecting pipe 23 using the valve 29, operation of the thermosyphon 20 may substantially stop.

After the predetermined time has passed after closing the second connecting pipe 23 using the valve 29, only air or the gas-phase refrigerant may fill the evaporating portion 22, or the liquid-phase refrigerant and the gas-phase refrigerant may coexist in the evaporating portion 22. For example, if the amount of the refrigerant injected into the thermosyphon 20 is relatively small, only air may be present in the evaporating portion 22 because all the refrigerant of the evaporating portion 22 has been vaporized and moved upward through the first connecting pipe 24. Also, if the amount of the refrigerant injected into the thermosyphon 20 is a medium level, a part of the gas-phase refrigerant present in the evaporating portion 22 may fail to move to the condensing portion 21 because the interior pressure of the thermosyphon 20 increases due to the refrigerant vaporized in the evaporating portion 22.

On the other hand, if the amount of the refrigerant injected into the thermosyphon 20 is relatively great, the interior pressure of the thermosyphon 20 may increase as a part of the liquid-phase refrigerant is vaporized in the evaporating portion 22, which causes a part of the liquid-phase refrigerant present in the evaporating portion 22 to fail to be vaporized. Since the thermosyphon 20 has a hermetically sealed interior space and the gas-phase refrigerant has a greater volume than the liquid-phase refrigerant having the same mass, the greater the amount of the gas-phase refrigerant, the interior pressure of the thermosyphon 20 may be greater. Also, the increased interior pressure may raise the vaporization temperature of the gas-phase refrigerant. If the interior pressure of the thermosyphon 20 increases by an excessive amount, a part of the liquid-phase refrigerant received in the evaporating portion 22 may fail to be vaporized.

The valve 29 may be located at a middle position of the circulation structure of the thermosyphon 20. In particular, to ensure that the refrigerant is maintained in a liquid phase in the condensing portion 21 to store cold air of the freezing compartment 11 therein while the thermosyphon 20 is not in operation, and to prevent reverse circulation of the liquid-phase refrigerant, the valve 29 may be installed at the second connecting pipe 23.

The valve 29 may be opened when the cooling cycle 15 exhibits abnormal operation. However, since supply of power stops in case of power outage, to allow the valve 29 to be operated even in case of power outage, the valve 29 may be formed of a deformable material, the shape of which can vary based on temperature change, or the valve 29 may be operated upon receiving power from a rechargeable battery in which a small amount of power is previously charged.

Figure 8:
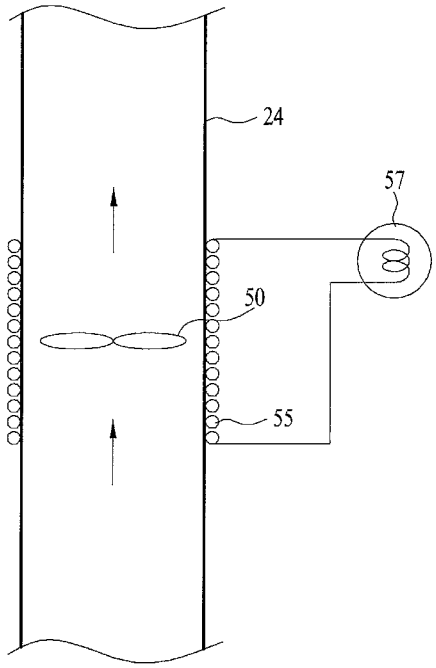
FIG. 8 is a view showing an embodiment of a propeller provided in a first connecting pipe according to the present disclosure.

In the case in which the refrigerant circulates through the open valve 29 while undergoing phase change, pressure may be applied to the first connecting pipe 24 as the gas-phase refrigerant moves upward. To generate electric power using the pressure, as shown in FIG. 8, a magnetic propeller 50 may be provided in the first connecting pipe 24 and a coil 55 may be wound about the first connecting pipe 24 around the magnetic propeller 50. To acquire desired magnetic force, the propeller 50 may be formed of a magnetic material, or may be provided with a magnet. If the propeller 50 is rotated by the gas-phase refrigerant flowing in the first connecting pipe 24, lines of magnetic force are changed by rotation of the propeller 50, causing current to be applied to the coil 55 by induced electromotive force.

Even though the amount of current is not great, the current may be utilized to turn on a lamp within the refrigerator body 10, or to sound an alarm light that shows whether or not the thermosyphon 20 is normally operated. Alternatively, the current may be utilized in places where a small amount of power is required to operate a small fan, etc. for enhancement of cooling efficiency.

Hereinafter, an embodiment in which the cooling aid 30 is provided in the freezing compartment 11 to preserve coldness of the freezing compartment 11 and to allow the refrigeration compartment 12 to be maintained at a low temperature for a longer time even in case of power outage will be described in more detail.

The cooling aid 30 may be a thermal storage device. The cooling aid 30 may include a phase change material (PCM). The PCM is a material, the phase of which may be changed, for example, from liquid to gas, from liquid to solid, or from gas to solid at a predetermined temperature. Since great energy must be consumed or emitted to cause phase change without temperature change at a melting point or boiling point, the phase change material may be used to store energy within a specific temperature range.

If a phase change material, which changes into solid state at a temperature higher than the temperature of the freezing compartment 11 upon normal operation, is provided in the freezing compartment 11, the phase change material is changed into solid via heat exchange with the interior of the freezing compartment 11. Then, if operation of the cooling cycle 15 stops and the temperature of the freezing compartment 11 increases, the phase change material changes from a solid to liquid by absorbing heat from it's surroundings. The phase change material can maintain a constant temperature during phase change, and therefore, may serve to restrict or reduce temperature increase within the refrigerator during a power outage, for example.

The thermosyphon 20 of the present disclosure may serve to cool the refrigeration compartment 12 using cold air of the freezing compartment 11 in case of power outage. Thus, when using the cooling aid 30, it is possible to cool the refrigeration compartment 12 for a longer period of time. The cooling aid 30 and the thermosyphon 20 may be spaced apart from each other. Also, the cooling aid 30 may be located near the condensing portion 21 to undergo heat exchange with the condensing portion 21 in a thermally conductive manner, which may facilitate liquefaction of the refrigerant in the condensing portion 21.

Figure 9:
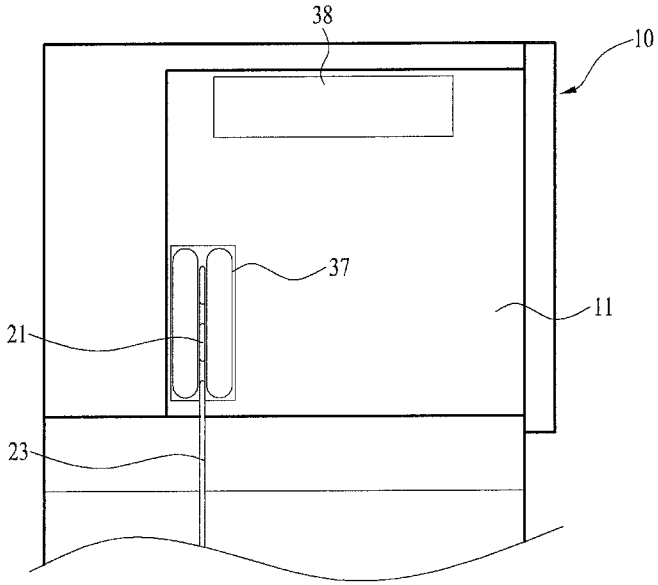
FIG. 9 is a side sectional view showing the arrangement of a condensing portion and a cooling aid within a refrigerator according to a first embodiment of the present disclosure.

In the case in which a cooling aid is used to prevent temperature increase within the freezing compartment 11, as shown in FIG. 9, a freezing compartment cooling aid 38 may be placed in an upper region of the freezing compartment 11, which ensures uniform movement of cold air throughout the freezing compartment 11. In this case, however, there may be a problem in that, separately from the freezing compartment cooling aid 38, providing a refrigeration compartment cooling aid may be necessary to cool the refrigeration compartment 12 via heat exchange with the thermosyphon 20.

Figure 10:
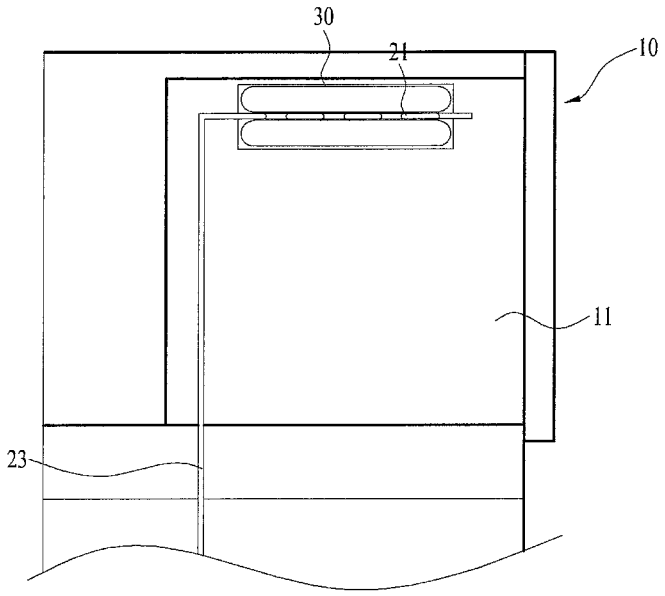
FIG. 10 is a side sectional view showing the arrangement of a condensing portion and a cooling aid within a refrigerator according to a second embodiment of the present disclosure.

Accordingly, to acquire an integral structure capable of realizing cooling of the freezing compartment 11 and cooling of the refrigeration compartment 12 simultaneously, as shown in FIG. 10, the condensing portion 21 may be horizontally installed to the ceiling of the freezing compartment 11, and the cooling aid 30 may be located near the condensing portion 21.

The horizontal arrangement is advantageous in terms of high space utility and maintenance of the uniform temperature of the freezing compartment 11. To prevent backflow of the refrigerant when the condensing portion 21 is horizontally arranged, as described above, the first backflow prevention pipe 26 may be provided at the entrance 21*a* of the condensing portion 21.

Since the refrigerant must flow in the opposite direction of gravity in order to pass through the first backflow prevention pipe 26, there is a reduced risk of the liquid-phase refrigerant liquefied in the condensing portion 21 moving backward to the first connecting pipe 24. The horizontally arranged condensing portion 21 has been described above in detail, and thus, a repeated description thereof will be omitted hereinafter.

Figure 11:
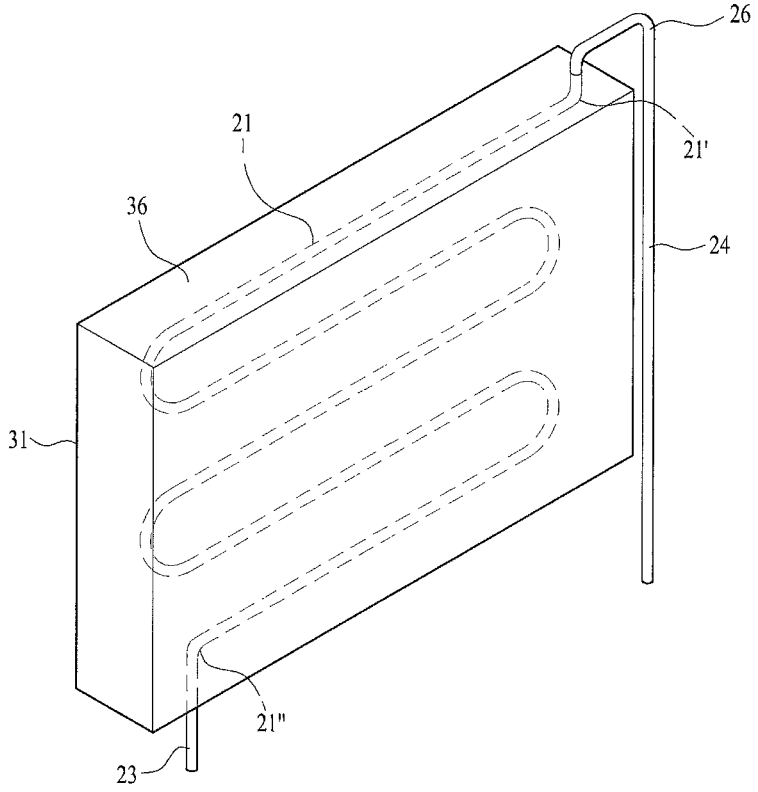
FIG. 11 is a perspective view showing one embodiment of a condensing portion and a cooling aid according to the present disclosure.

Next, a configuration of the cooling aid 30 will be described in consideration of heat exchange efficiency with the condensing portion 21. FIG. 11 is a perspective view showing a first embodiment of the condensing portion 21 and the cooling aid 30 according to the present disclosure. The cooling aid 30 may include a housing 31. The housing may have an opening for the condensing portion 21 to be positioned through or to penetrate the cooling aid 30. That is, the housing may be formed to surround the condensing portion 21 to increase heat exchange. The housing 31 may have a hollow space formed therein to accommodate a phase change material 36 filled in the hollow space.

Although the above described embodiment has a simplified configuration, different configurations may be provided based on the desired functionality. For example, the phase change material 36 may cause corrosion of the condensing portion 21. Thus, to solve this problem, a surface of the condensing portion 21 may be coated with a resin or plastic based material. Moreover, a volume of the phase change material 36 filled in the housing 31 may vary due during the phase change. To deal with the volume change, the housing 31 may be formed of a deformable material such that the internal volume thereof is variable.

Figure 12:
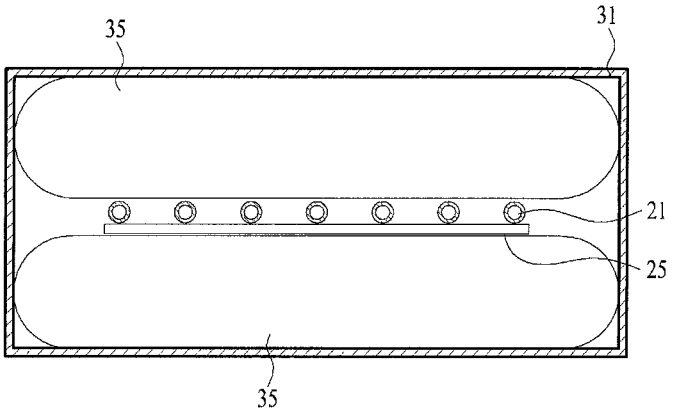
FIG. 12 is a side sectional view showing one embodiment of a condensing portion and a cooling aid according to the present disclosure.

FIG. 12 is a side sectional view showing a condensing portion 21 and the cooling aid 30 according to one embodiment of the present disclosure. In contrast to the embodiment of FIG. 11 in which the phase change material 36 is directly filled in the housing 31, in this embodiment a plastic pack 35, into which a phase change material is injected, may be inserted into the housing 31. The plastic pack 35 may provide a physical barrier to prevent corrosion of the condensing portion 21.

Moreover, even if the phase change material within the plastic pack 35 is changed into a liquid phase, risks of leakage from the housing 31 may be reduced. The present embodiment may be relatively easily embodied because the plastic pack 35 may be any commercially available one. Also, since the shape of the plastic pack 35 can be changed to suit the surroundings, the plastic pack 35 may come into close contact with a surface of the condensing portion 21.

The present embodiment may be applied to both horizontal and vertical arrangements of the condensing portion 21, and FIG. 12 shows the horizontally arranged condensing portion 21. Owing to locating a pair of plastic packs 35 at upper and lower sides of the condensing portion 21, enhanced heat exchange efficiency between the plastic packs 35 and the condensing portion 21 may be accomplished.

Figure 13:
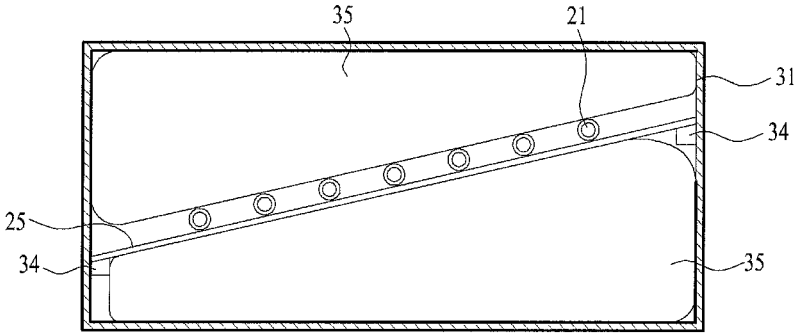
FIG. 13 is a side sectional view showing one embodiment of a condensing portion and a cooling aid according to the present disclosure.

FIG. 13 is a side sectional view showing a third embodiment of the condensing portion 21 and the cooling aid 30 according to the present disclosure. The housing 31 may be provided at an inner surface thereof with protrusions 34 to support the condensing portion 21 such that the condensing portion 21 is stably secured to the housing 31. Although the housing 31 is horizontally arranged, to allow the condensing portion 21 located within the housing 31 to be tilted by a predetermined angle, one protrusion toward the entrance 21*a* of the condensing portion 21 may be located higher than the other protrusion toward the exit 21*b* of the condensing portion 21.

As a result, the entrance 21*a* of the condensing portion 21 may be maintained at a higher position than the exit 21*b* of the condensing portion 21, which allows the liquid-phase refrigerant to more smoothly move to the second connecting pipe 23. In this case, the phase change material may be directly injected into the housing 31, or the plastic pack 35 into which the phase change material is injected may be inserted into the housing 31. The plastic pack 35 or the directly injected phase change material may be deformed to suit to the interior space of the housing 31, thereby coming into close contact with the condensing portion 21.

Figure 14:
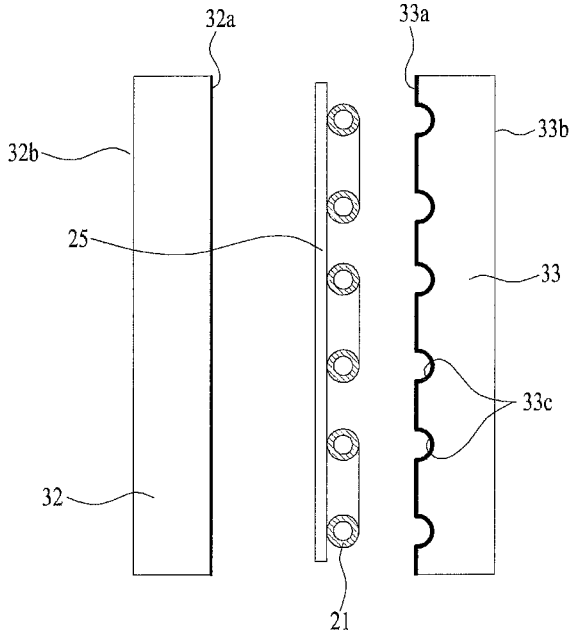
FIG. 14 is a side sectional view showing one embodiment of a condensing portion and a cooling aid according to the present disclosure.
Figure 15:
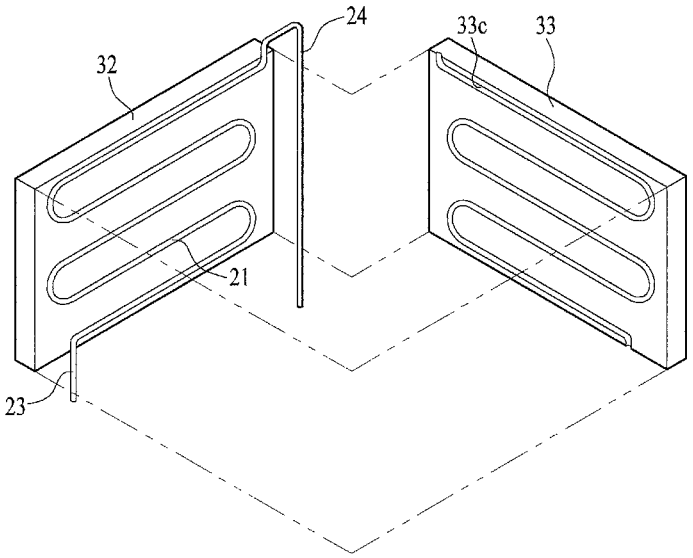
FIG. 15 is a perspective view showing the condensing portion and the cooling aid of FIG. 14.

FIG. 14 is a side sectional view showing a one embodiment of the condensing portion 21 and the cooling aid 30 according to the present disclosure. FIG. 15 is a perspective view showing another embodiment of the condensing portion 21 and the cooling aid 30 according to the present disclosure. The embodiment as shown in FIG. 14 has a feature that cases 32 and 33, into which the phase change material is injected, may be coupled to both sides of the condensing portion 21.

To further come into close contact with the condensing portion 21, the case 33 may be provided at a surface thereof facing the condensing portion 21 with grooves 33*c* corresponding to the shape of the condensing portion 21, which may increase a contact area between the condensing portion 21 and the cooling aid 30. That is, the grooves may be formed such that they correspond to the shape of the pipe of the condensing portion 21 and surround the pipe to increase the contact area between the cooling aid 30 and the condensing portion 21. Although FIGS. 14 and 15 show the grooves 33*c* as being formed only at one case 33, both the cases 32 and 33 may be provided with the grooves.

The cases 32 and 33 may be deformable such that the volume of an interior space thereof is variable to deal with a volume change of the phase change material received in the cases 32 and 33. In this case, since pressure is applied to the condensing portion 21 if surfaces 32*a* and 33*a* of the cases 32 and 33 facing the condensing portion 21 are deformed following the volume change of the phase change material, it may be necessary to minimize deformation of the surfaces 32*a* and 33*a*.

To provide the surfaces 32*a* and 33*a* facing the condensing portion 21 with a greater strength than other portions 32*b* and 33*b* of the cases 32 and 33, the surfaces 32*a* and 33*a* facing the condensing portion 21 may have a greater thickness than the portions 32*b* and 33*b*. In this way, since the portions 32*b* and 33*b* may also be deformed to suit to the volume change of the phase change material, it is possible to minimize pressure to be applied to the condensing portion 21. Alternatively, a reinforcing member may be added to the surfaces 32*a* and 33*a* facing the condensing portion 21 to minimize deformation of the cases 32 and 33.

Additionally, to enhance heat exchange efficiency between the condensing portion 21 and the cases 32 and 33, thermal grease may be applied to the surfaces 32*a* and 33*a* of the cases 32 and 33 facing the condensing portion 21.

As shown in FIG. 9, in the case in which the refrigeration compartment cooling aid 37 and the freezing compartment cooling aid 38 are individually provided, the refrigeration compartment cooling aid 37 and the freezing compartment cooling aid 38 may use individual phase change materials having different melting points. If the phase change material used in the refrigeration compartment cooling aid 37 and the phase change material used in the freezing compartment cooling aid 38 have the same melting point, even the refrigeration compartment cooling aid 37 may be used for cooling of the freezing compartment 11, which may deteriorate cooling efficiency of the refrigeration compartment 12.

Accordingly, to achieve effective cooling of the refrigeration compartment 12, the phase change material used in the refrigeration compartment cooling aid 37 may have a higher melting point than the phase change material used in the freezing compartment cooling aid 38. For example, assuming that the melting point of the phase change material used in the freezing compartment cooling aid 38 is −12° C., the refrigeration compartment cooling aid 37 may use a phase change material having a melting point of −8° C.

In the case in which the integral cooling aid 30 for use in cooling of both the refrigeration compartment 12 and the freezing compartment 11 is divided into the plurality of cases 32 and 33, or the plurality of plastic packs 35 as described in the second to fourth embodiments with reference to FIGS. 12 to 14, the phase change materials used in the plastic packs 35 or the cases 32 and 33 may have different melting points.

In this case, the phase change material having a lower melting point is used for cooling of the freezing compartment 11, and thus, may be referred to as a freezing compartment cooling aid, and the phase change material having a higher melting point is used for cooling of the refrigeration compartment 12, and thus, may be referred to as a refrigeration compartment cooling aid that undergoes heat exchange with the thermosyphon 20.

In particular, as shown in FIGS. 12 and 13, the cooling aid 30 coupled to the horizontally arranged condensing portion 21 may include an upper cooling aid and a lower cooling aid having a higher melting point than the upper cooling aid, which is helpful to maintain cooling of the freezing compartment 11.

Figure 16:
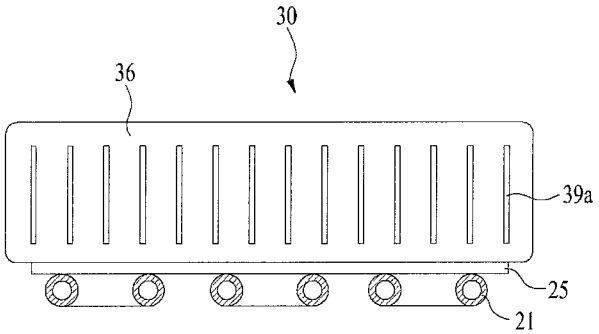
FIG. 16 is a side sectional view showing one embodiment of a condensing portion and a cooling aid according to the present disclosure.
Figure 17:
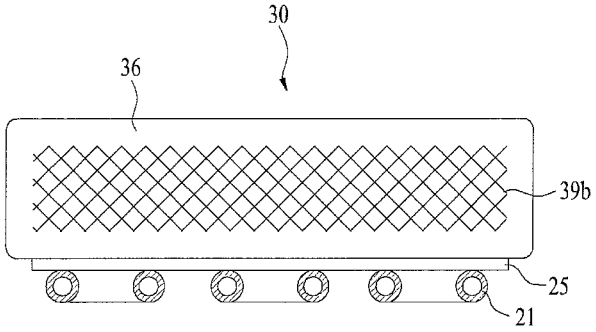
FIG. 17 is a side sectional view showing one embodiment of a condensing portion and a cooling aid according to the present disclosure.

FIGS. 16 and 17 are views showing a configuration in which thermally conductive members 39*a* and 39*b* are inserted into the phase change material 36 of the cooling aid 30. The phase change material 36 may have a very low thermal conductivity similar to a heat insulating material. In this case, even if phase change occurs at a surface of the phase change material, the center of the phase change material may have yet to undergo a phase change.

Accordingly, to reduce a temperature difference between the exterior and the interior of the phase change material 36, as shown in FIG. 16, the thermally conductive members 39*a* may be inserted into the phase change material 36 to thermally connect the surface and the center of the phase change material 36 to each other. Also, as shown in FIG. 17, the porous or mesh type thermally conductive member 39*b* may be inserted to connect the surface and the center of the phase change material 36 to each other, which may reduce a temperature difference between the surface and the center of the phase change material 36, resulting in enhanced efficiency of the thermosyphon 20. The thermally conductive members 39*a* and 39*b* may be formed of a metal, plastic, graphite, or another appropriate type of thermally conductive material.

As described above, the cooling aid 30 provided to preserve coldness of the freezing compartment 11 may store cold air during normal operation of the cooling cycle 15 such that the cold air can be used while the cooling cycle 15 is not in operation, thereby serving to improve performance of the thermosyphon 20.

Next, the thermosyphon 20, which further includes an accumulator 40 or 47, will be described with reference to FIGS. 18 to 24. During normal operation of the cooling cycle 15, the valve 29 provided at the second connecting pipe 23 may be closed, causing the liquid-phase refrigerant to be accumulated in the second connecting pipe 23 above the valve 29 until the refrigerant fills the condensing portion 21.

However, if the amount of the refrigerant present in the thermosyphon 20 is greater than a volume from above the valve 29 to the entrance 21*a* of the condensing portion 21, the refrigerant may remain in the first connecting pipe 24 beyond the first backflow prevention pipe 26 near the entrance 21*a* of the condensing portion 21. In this case, the refrigerant may unnecessarily circulate in the first connecting pipe 24 even while the valve 29 is closed and the thermosyphon 20 is not in operation.

For example, assuming that the amount of the refrigerant is 70 ml and the volume from above the valve 29 on the second connecting pipe 23 to the entrance 21*a* of the condensing portion 21 is 50 ml, 20 ml of excess refrigerant will undergo phase change while vertically moving in the first connecting pipe 24 despite that the thermosyphon 20 is not in operation.

Figure 18:
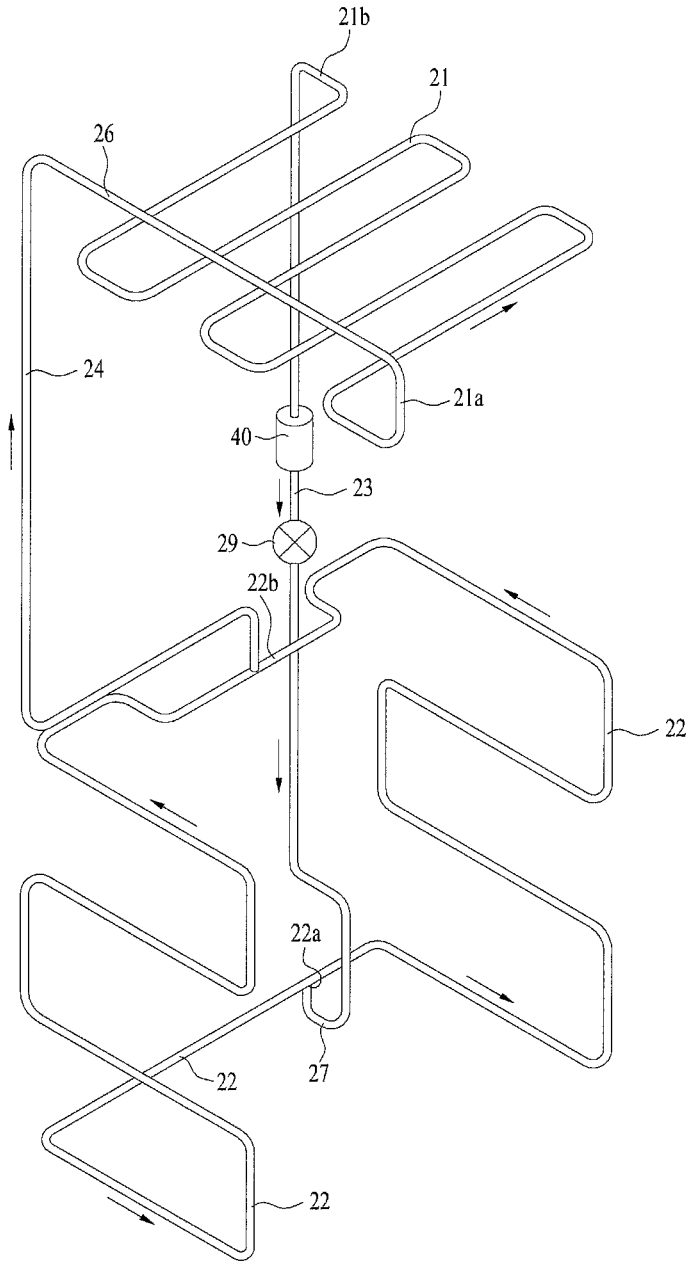
FIG. 18 is a perspective view showing an embodiment of an accumulator according to the present disclosure.

To solve this problem, the pipe diameter of the condensing portion 21 may be formed to be greater than the pipe diameter of the evaporating portion 22. However, fabricating the condensing portion 21 and the evaporating portion 22 with different sizes of pipes may problematically increase manufacturing and other associated costs. To solve this problem, in the embodiment as shown in FIG. 18, the accumulator 40 capable of receiving extra refrigerant present in the second connecting pipe 23 above the valve 29 or present in the condensing portion 21 may be provided.

Figure 19:
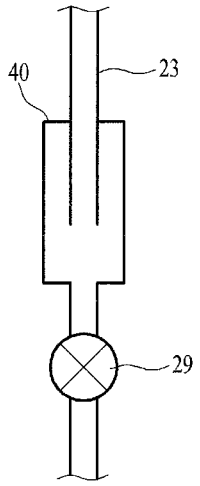
FIG. 19 is a sectional view of the embodiment of the accumulator according to the present disclosure.

The accumulator 40 may also be a reservoir. The accumulator 40 may be positioned above the valve 29 on the second connecting pipe 23 or may be connected to the condensing portion 21. Referring to FIG. 18, the accumulator 40 may be positioned above the valve 29 on the second connecting pipe 23. FIG. 19 is a sectional view showing an embodiment of the accumulator 40 according to the present disclosure. As shown in FIG. 19, the accumulator 40 may have a predetermined space connected to the second connecting pipe 23 above the valve 29.

To allow the liquid-phase refrigerant to easily move downward along the second connecting pipe 23 when the valve 29 is opened and the thermosyphon 20 is operated, as shown in FIG. 19, the second connecting pipe 23 may be configured to extend from above the accumulator 40 to the interior of the accumulator 40. If the second connecting pipe 23 does not extend into the accumulator 40 as shown in FIG. 19, it may be necessary that the liquid-phase refrigerant entering the accumulator 40 must first flow along an inner wall surface of the accumulator 40 prior to reaching the outlet of the accumulator 40. This may unnecessarily increase a distance in which the refrigerant must travel and may deteriorate smooth circulation of the refrigerant.

Figure 20:
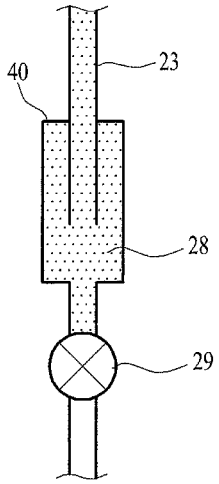
FIG. 20 is a sectional view that illustrates the embodiment of the accumulator according to the present disclosure when operation of a thermosyphon stops.

FIG. 20 is a sectional view that illustrates an operation of the accumulator 40 according to the present disclosure when the operation of a thermosyphon 20 stops. As the valve 29 is closed and the liquid-phase refrigerant is gathered above the valve 29, the refrigerant fills the accumulator 40 as shown in FIG. 20.

The volume of the refrigerant receivable in the accumulator 40 must be greater than a difference between the volume from above the valve 29 on the second connecting pipe 23 to the entrance 21*a* of the condensing portion 21 and the volume of the refrigerant present in the thermosyphon 20. This serves to prevent the liquefied refrigerant from moving to the first connecting pipe 24 beyond the first backflow prevention pipe 26 near the entrance 21*a* of the condensing portion 21.

For example, assuming that the amount of the refrigerant is 70 ml and the volume from above the valve 29 on the second connecting pipe 23 to the entrance 21*a* of the condensing portion 21 is 50 ml, the capacity of the accumulator 40 must be 20 ml or more such that 20 ml of the excess refrigerant can be stored in the accumulator 40 while the thermosyphon 20 is not in operation.

Figure 21:
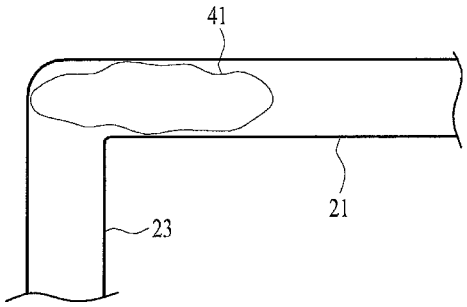
FIG. 21 is a sectional view that illustrates non-condensable gas within a condensing portion.

FIG. 21 is a sectional view showing non-condensable gas 41 within the condensing portion 21. The non-condensable gas 41 is a material that has a low boiling point and is not liquefied in the freezing compartment 11. The non-condensable gas 41 may be introduced upon injection of the refrigerant, or may be generated while the refrigerant circulates through the thermosyphon 20. The non-condensable gas 41, as shown in FIG. 21, may clog the condensing portion 21 and serves as an obstacle to the flow of the refrigerant.

Figure 22:
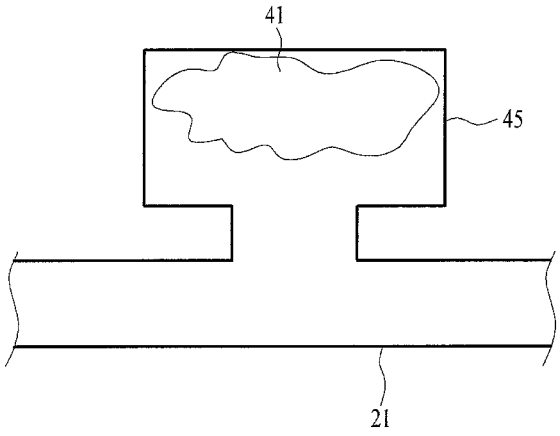
FIG. 22 is a sectional view showing an embodiment of a receiving chamber according to the present disclosure.

Although it is desirable to periodically remove the non-condensable gas 41, the thermosyphon 20 is embedded in the refrigerator and may not be easily opened or serviced. Therefore, as shown in FIG. 22, a receiving chamber 45 may be added to the condensing portion 21.

The receiving chamber 45 provides a predetermined space that protrudes upward of the condensing portion 21 and is connected to the condensing portion 21. Since the receiving chamber 45 protrudes upward from the condensing portion 21, the non-condensable gas 41, which has a lower weight than the liquid-phase refrigerant, may be gathered in the receiving chamber 45.

Figure 23:
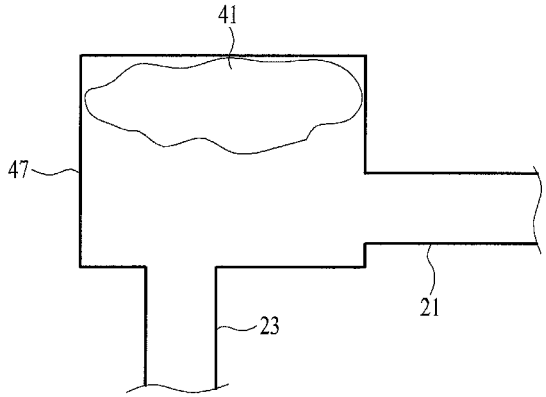
FIG. 23 is a sectional view showing another embodiment of an accumulator according to the present disclosure.
Figure 24:
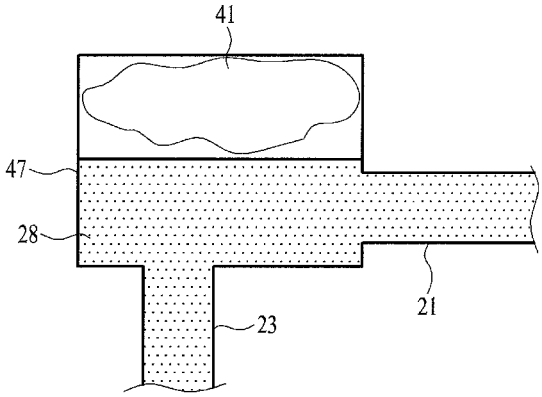
FIG. 24 is a sectional view that illustrates another embodiment of the accumulator according to the present disclosure when operation of a thermosyphon stops.

Although the receiving chamber 45 may be provided separately from the above described accumulator 40, as shown in FIG. 23, the receiving chamber 45 may be integrally formed with the accumulator 47. The accumulator 47 may be positioned between the condensing portion 21 and the second connecting pipe 23. In this case, an upper portion of the accumulator 47 may protrude upward from the condensing portion 21. The upwardly protruding portion of the accumulator 47 may also function as the above described receiving chamber 45 as illustrated in FIG. 24. The integral accumulator 47 may be a combination of the accumulator 40 and the receiving chamber 45.

FIG. 24 illustrates a state in which the liquefied refrigerant 28 fills the integral accumulator 47 while the thermosyphon 20 is not in operation. The integral accumulator 47 may be fabricated to be larger than the accumulator 40 of FIG. 19 in consideration of a space needed for receiving the non-condensable gas 41.

As described above, by adding the accumulator 47 to the second connecting pipe 23, it may be possible to prevent the liquefied refrigerant from being introduced into the first connecting pipe 24 when operation of the thermosyphon 20 stops, which may ensure stable operation of the thermosyphon 20.

As disclosed herein, in a refrigerator having a thermosyphon according to the present disclosure, even if a cooling cycle cannot operate due to power outage, breakdown, or the like, or when available power supply is restricted, it is possible to minimize temperature increase within the refrigerator, more particularly, in a refrigeration compartment, thereby preventing spoilage of food.

Further, as a result of providing the thermosyphon with a backflow prevention pipe, or positioning entrances and exits of a condensing portion and an evaporating portion up and down based on the kinds of refrigerant, it may be possible to prevent backflow of refrigerant and to allow the refrigerant to flow in a prescribed direction.

Furthermore, as a result of providing a freezing compartment with a cooling aid, such as a phase change material, it may be possible to minimize temperature increases in the freezing compartment and the refrigeration compartment even in case of power outage.

In addition, an accumulator (or reservoir) may serve to prevent backflow and unnecessary movement of refrigerant when the thermosyphon is turned off, e.g., in a closed state of a valve. Also, the condensing portion may be provided with a receiving chamber in which gas that has not undergone phase change in the thermosyphon, e.g., non-condensable gas, can be separated from a closed flow path, which may prevent the thermosyphon from being clogged by the non-condensable gas.

As embodied and broadly described herein, a refrigerator may include a refrigerator body having a freezing compartment and a refrigeration compartment, a cooling cycle including a compressor to compress hydraulic fluid, the cooling cycle serving to supply cold air into the refrigerator body, a thermosyphon including a condensing portion located in the freezing compartment to liquefy refrigerant, an evaporating portion located in the refrigeration compartment to vaporize the refrigerant, a first connecting pipe configured to connect an exit of the evaporating portion and an entrance of the condensing portion to each other, and a second connecting pipe configured to connect an exit of the condensing portion and an entrance of the evaporating portion to each other, and a valve provided at the second connecting pipe to open or close the second connecting pipe, wherein the cooling cycle is not operated if the thermosyphon is operated.

In one embodiment, a refrigerator may include a refrigerator body having a freezing compartment and a refrigeration compartment, and a cooling circuit including a compressor, a condenser, and an evaporator to cool the freezing compartment and the refrigeration compartment using a first refrigerant. The refrigerator may also include a thermosyphon that includes a pipe for a second refrigerant to flow, the pipe having a first section having a first prescribed shape, a second section having a second prescribed shape, a third section coupled between the first and second sections for the second refrigerant to flow from the first section to the second section, and a fourth section coupled between the first and second sections for the second refrigerant to flow from the second section to the first section. A valve may be provided at the third section of the pipe to open or close the pipe. The freezing compartment may be positioned adjacent to the refrigeration compartment, and the first section of the pipe may be positioned at the freezing compartment to undergo heat exchange with the freezing compartment and the second section of the pipe may be positioned at the refrigeration compartment to undergo heat exchange with the refrigeration compartment. The first section may be positioned higher than the second section. The second refrigerant may change state from a gaseous state to a liquid state in the first region of the pipe and may change state from a liquid state to a gaseous state in the second region of the pipe. Moreover, the cooling circuit and the thermosyphon may be operated independently.

The first section of the pipe may be a second condenser and the second section of the pipe may be a second evaporator. The prescribed shapes of the first and second sections may be serpentine shapes. 4. The freezing compartment may be provided over the refrigeration compartment.

The refrigerator may further include a controller that controls the thermosyphon to operate when the cooling circuit is not operational. The second refrigerant in the thermosyphon may have a vaporization temperature equal to or less than a lowest temperature of the refrigeration compartment during normal operation of the cooling circuit.

The pipe may include at least one fifth section having a third prescribed shape that prevents backflow of refrigerant in the pipe. One of the at least one fifth section of the pipe may be positioned between the first section of the pipe for condensing refrigerant and the fourth section of the pipe to prevent backflow of the second refrigerant in a liquid state from the first section. One of the at least one fifth section of the pipe may be positioned between the second section of the pipe for evaporating refrigerant and the third section of the pipe to prevent backflow of the second refrigerant in a gaseous state from the second section.

The first section of the pipe for condensing refrigerant may be inclined downward from an inlet to an outlet of the first section of the pipe. The second section of the pipe for evaporating refrigerant may be inclined upward from an inlet to an outlet of the second section of the pipe. The refrigerator may further include a thermal storage device provided the freezing compartment to undergo heat exchange with the first section of the pipe of the thermosyphon, and a phase change material may be provided in the thermal storage device.

A reservoir may be provided at the fourth section of pipe or the first section of the pipe such that liquefied refrigerant is received in the reservoir when the flow of the refrigerant in the thermosyphon stops. A chamber that protrudes upward from the first section of the pipe such that gaseous refrigerant that did not undergo phase change from a gaseous state to a liquid state in the first section of the pipe may be collected in the chamber.

In one embodiment, a refrigerator may include a refrigerator body having a freezing compartment and a refrigeration compartment, a cooling circuit including a compressor, a first condenser, an expander, and a first evaporator to cool the freezing compartment and a refrigeration compartment using a first refrigerant, a thermosyphon that includes a second condenser, a second evaporator, a first pipe for a second refrigerant to flow from the second evaporator to the second condenser, and a second pipe for the second refrigerant to flow from the second condenser to the second evaporator, a valve provided at the second pipe to open or close the second pipe, and a thermal storage device provided at the freezing compartment to undergo heat exchange with the second condenser. The freezing compartment may be positioned adjacent to the refrigeration compartment, and the second condenser may be positioned at the freezing compartment to undergo heat exchange with the freezing compartment and the second evaporator may be positioned at the refrigeration compartment to undergo heat exchange with the refrigeration compartment. The second condenser may be positioned higher than the second evaporator.

The second condenser and the second evaporator may include a pipe having a serpentine shape for the second refrigerant to undergo heat exchange. The thermal storage device may be positioned inside the freezing compartment. The thermal storage device may includes a plastic pack for a Phase Change Material (PCM) and a housing for the plastic pack. The housing may include at least one opening for the second condenser to come into contact with the plastic pack. The thermal storage device may include a pair of cases configured to receive the PCM therein. At least one of the pair of cases may be provided, at a surface thereof facing the second condenser, with at least one a groove having a shape corresponding to the shape of the second condenser.

In one embodiment, a refrigerator may include a refrigerator body having a freezing compartment and a refrigeration compartment, a cooling circuit including a compressor, a first condenser, and a first evaporator to cool the freezing compartment and a refrigeration compartment using a first refrigerant, a thermosyphon that includes a second condenser, a second evaporator, a first pipe for a second refrigerant to flow from the second evaporator to the second condenser, and a second pipe for the second refrigerant to flow from the second condenser to the second evaporator, a valve provided at the second pipe to open or close the second pipe, and a control circuit to control an operation of the thermosyphon. The freezing compartment may be positioned adjacent to the refrigeration compartment, and the second condenser may be positioned at the freezing compartment to undergo heat exchange with the freezing compartment and the second evaporator may be positioned at the refrigeration compartment to undergo heat exchange with the refrigeration compartment. The second condenser may be positioned higher than the second evaporator. When the cooling circuit is turned off, the control circuit may open the valve to operate the thermosyphon. Moreover, the control circuit may be configured to detect an operational state of the cooling circuit and open the valve to operate the thermosyphon during a power failure.

In one embodiment, a refrigerator may include a refrigerator body having a freezing compartment and a refrigeration compartment, a cooling circuit including a compressor, a condenser, and an evaporator to cool the freezing compartment and a refrigeration compartment using a first refrigerant, a thermosyphon that includes a pipe for a second refrigerant to flow, the pipe having a first section having a first prescribed shape for condensing refrigerant, a second section having a second prescribed shape for evaporating refrigerant, a third section coupled between the first and second sections for the second refrigerant to flow from the first section to the second section, a fourth section coupled between the first and second sections for the second refrigerant to flow from the second section to the first section, and at least one fifth section having a third prescribed shape that prevents a backflow of the second refrigerant in the pipe, and a valve provided at the second pipe to open or close the second pipe. The freezing compartment may be positioned adjacent to the refrigeration compartment, and the first section of the pipe may be positioned at the freezing compartment to undergo heat exchange with the freezing compartment and the second section of the may be positioned at the refrigeration compartment to undergo heat exchange with the refrigeration compartment. The first section may be positioned higher than the second section.

One of the at least one fifth section of the pipe may be positioned between the first section of the pipe for condensing refrigerant and the fourth section of the pipe to prevent backflow of the second refrigerant in a liquid state from the first section. Moreover, one of the at least one fifth section of the pipe may be positioned between the second section of the pipe for evaporating refrigerant and the third section of the pipe to prevent backflow of the second refrigerant in a gaseous state from the second section.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a refrigerator body having a freezing compartment and a refrigeration compartment;

a cooling circuit including a compressor, a condenser, and an evaporator to cool the freezing compartment and the refrigeration compartment using a first refrigerant;

a thermosyphon that includes a pipe for a second refrigerant to flow, the pipe having a first section having a first prescribed shape, a second section having a second prescribed shape, a third section coupled between the first and second sections for the second refrigerant to flow from the first section to the second section, and a fourth section coupled between the first and second sections for the second refrigerant to flow from the second section to the first section; and a valve provided at the pipe to open or close the pipe, wherein the freezing compartment is positioned adjacent to the refrigeration compartment, and the first section of the pipe is positioned at the freezing compartment to undergo heat exchange with the freezing compartment and the second section of the pipe is positioned at the refrigeration compartment to undergo heat exchange with the refrigeration compartment, the first section being positioned higher than the second section, wherein the second refrigerant changes state from a gaseous state to a liquid state in the first section of the pipe and changes state from a liquid state to a gaseous state in the second section of the pipe, wherein the cooling circuit and the thermosyphon are operated independently, wherein the pipe includes a fifth section having a third prescribed shape that prevents the second liquid refrigerant in the first section from moving into the fourth section through the fifth section, wherein the fifth section is positioned at an entrance of the first section and extends above the first section such that all refrigerant moving from the fourth section to the first section ascends above the top of the first section while passing through the fifth section and descends at the entrance of the first section, and wherein the second refrigerant goes down in the gaseous state and goes up in the liquid state in the thermosyphon.

2. The refrigerator of claim 1, wherein the first section of the pipe is a second condenser and the second section of the pipe is a second evaporator, and the prescribed shapes of the first and second sections are serpentine shapes.

3. The refrigerator of claim 1, wherein the first section of the pipe is a second condenser and the second section of the pipe is a second evaporator, and the second condenser is positioned a prescribed height above the second evaporator.

4. The refrigerator of claim 1, wherein the freezing compartment is provided over the refrigeration compartment.

5. The refrigerator of claim 1, wherein the first section of the pipe is positioned adjacent to an outer surface of the freezing compartment and the second section of the pipe is positioned adjacent to an outer surface of the refrigeration compartment.

6. The refrigerator of claim 3, wherein a plate is positioned between the first section of the pipe and the outer surface of the freezing compartment and a second plate is positioned between the second section of the pipe and the outer surface of the refrigeration compartment.

7. The refrigerator of claim 1, wherein the first section of the pipe is positioned adjacent to an inner surface of the freezing compartment and the second section of the pipe is positioned adjacent to an inner surface of the refrigeration compartment.

8. The refrigerator of claim 1, further including a controller that controls the valve to be open when the thermosyphon is operational.

9. The refrigerator of claim 1, further includes a controller that controls the cooling circuit to not operate when the thermosyphon is operational.

10. The refrigerator of claim 1, further includes a controller that controls the thermosyphon to operate when the cooling circuit is not operational.

11. The refrigerator of claim 1, further includes a controller that controls the thermosyphon to provide auxiliary cooling to the refrigeration chamber when the cooling circuit is not operational.

12. The refrigerator of claim 11, wherein the cooling circuit is not operational during at least one of a power outage in which external electric power is not supplied, a failure of the cooling cycle, or time periods external electric power rate is high.

13. The refrigerator of claim 1, further comprising a controller that controls the valve to close the fourth section of the pipe to prevent operation of the thermosyphon when the cooling circuit is operated.

14. The refrigerator of claim 1, wherein the second refrigerant in the thermosyphon has a vaporization temperature equal to or less than a highest temperature of the refrigeration compartment during normal operation of the cooling circuit.

15. The refrigerator of claim 1, wherein the second refrigerant in the thermosyphon has a vaporization temperature equal to or less than an average temperature of the refrigeration compartment during normal operation of the cooling circuit.

16. The refrigerator of claim 1, wherein the second refrigerant in the thermosyphon has a vaporization temperature equal to or less than a lowest temperature of the refrigeration compartment during normal operation of the cooling circuit.

17. The refrigerator of claim 1, wherein the fifth section of the pipe is positioned between the first section of the pipe for condensing refrigerant and the fourth section of the pipe to prevent backflow of the second refrigerant in a liquid state from the first section.

18. The refrigerator of claim 1, wherein the pipe includes a sixth section having a prescribed shape that prevents backflow of refrigerant in the pipe, and wherein the sixth section of the pipe is positioned between the second section of the pipe for evaporating refrigerant and the third section of the pipe to prevent backflow of the second refrigerant in a gaseous state from the second section.

19. The refrigerator of claim 1, wherein the first section of the pipe for condensing refrigerant is inclined downward from an inlet to an outlet of the first section of the pipe.

20. The refrigerator of claim 1, wherein the second section of the pipe for evaporating refrigerant is inclined upward from an inlet to an outlet of the second section of the pipe.

21. The refrigerator of claim 1, further including a thermal storage device provided at the freezing compartment to undergo heat exchange with the first section of the pipe of the thermosyphon, and a phase change material provided in the thermal storage device.

22. The refrigerator of claim 1, further including a reservoir provided at the fourth section of pipe or the first section of the pipe such that liquefied refrigerant is received in the reservoir when the flow of the refrigerant in the thermosyphon stops.

23. The refrigerator of claim 1, further including a chamber that protrudes upward from the first section of the pipe such that gaseous refrigerant that did not undergo phase change from a gaseous state to a liquid state in the first section of the pipe is collected in the chamber.

24. The refrigerator of claim 8, wherein the fifth section of the pipe is positioned between the first section of the pipe for condensing refrigerant and the fourth section of the pipe to prevent backflow of the second refrigerant in a liquid state from the first section.

25. The refrigerator of claim 8, wherein the pipe includes a sixth having a prescribed shape that prevents backflow of refrigerant in the pipe, and wherein the sixth section of the pipe is positioned between the second section of the pipe for evaporating refrigerant and the third section of the pipe to prevent backflow of the second refrigerant in a gaseous state from the second section.

* * * * *